US007460769B2

(12) United States Patent
Ryks

(10) Patent No.: US 7,460,769 B2
(45) Date of Patent: Dec. 2, 2008

(54) MODULAR WATER HEATING SYSTEMS

(76) Inventor: William R. Ryks, 12110 Nantucket Dr., Chardon, OH (US) 44024

( * ) Notice: Subject to any disclaimer, the term of this patent is extended or adjusted under 35 U.S.C. 154(b) by 0 days.

(21) Appl. No.: 11/554,927

(22) Filed: Oct. 31, 2006

(65) Prior Publication Data

US 2008/0152331 A1 Jun. 26, 2008

(51) Int. Cl.
*F24H 1/10* (2006.01)

(52) U.S. Cl. ..... 392/490; 392/441; 392/465

(58) Field of Classification Search ..... 392/490, 392/465

See application file for complete search history.

(56) References Cited

U.S. PATENT DOCUMENTS 1,731,368 A * 10/1929 Baker ..... 122/14.22
2,833,273 A * 5/1958 Miller ..... 122/14.3
3,408,093 A * 10/1968 Epstein ..... 285/52
3,575,157 A * 4/1971 Whittel, Jr. ..... 122/14.2
4,412,526 A * 11/1983 DeGrose ..... 122/14.1
4,691,726 A * 9/1987 Studer et al. ..... 137/15.17
4,977,885 A * 12/1990 Herweyer et al. ..... 122/14.31
4,991,876 A * 2/1991 Mulvey ..... 285/21.1
5,216,743 A * 6/1993 Seitz ..... 392/490
6,389,226 B1 * 5/2002 Neale et al. ..... 392/485
2005/0121540 A1 * 6/2005 Torigoe ..... 239/289

* cited by examiner

*Primary Examiner*—Thor S Campbell
(74) *Attorney, Agent, or Firm*—Renner, Otto, Boisselle & Sklar, LLP

(57) ABSTRACT

Modular water heating systems include a self-standing rack on which one or two separate tankless water heaters and a separate water storage tank are mounted. A pump recirculates the water between the storage tank and the water heater or heaters to maintain a drawdown supply of hot water. The various water lines between the tankless water heater or heaters, storage tank and water circulation pump may include isolation valves, quick connectors and flexible lines for easy replacement of any of the component parts as needed.

19 Claims, 4 Drawing Sheets

MODULAR WATER HEATING SYSTEMS

FIELD OF THE INVENTION

This invention relates to modular water heating systems for use in commercial applications where large quantities of hot water are needed.

BACKGROUND OF THE INVENTION

Hot water for most commercial applications that require large quantities of hot water, for example restaurants for washing dishes or other needs, is commonly supplied by standard commercial tank type water heaters. These types of heaters are oftentimes installed in limited access areas such as basements or mezzanines where the floor space for the hot water tanks is quite limited. A major drawback to these types of water heaters, besides their relatively high cost, is that when the tank fails, the entire water heater has to be replaced. Consequently no hot water is available during the time it takes to replace the water heater.

Commercial tankless water heating systems are available that may include multi-unit heaters that allow for service or replacement of one or more of the heaters without disrupting the entire hot water supply. However, these systems typically require a substantial amount of wall space to install them, which is oftentimes not available. Heretofore, there has been no known way to conveniently install tankless water heating systems in the same or comparable amount of space typically occupied by standard tank type water heaters in a relatively quick and inexpensive manner.

SUMMARY OF THE INVENTION

The present invention relates to self-contained modularized water heating systems comprised of individual component parts mounted on a rack for ease of installation of the entire systems as a unit and allowing for easy service or replacement of the individual component parts as needed without having to replace the entire systems.

In accordance with one aspect of the invention, the modularized systems are self-standing and may be sized to fit within substantially the same amount of space typically occupied by standard commercial tank type water heaters, whereby the systems may be used either in new installations and in retrofit situations as a direct replacement in the space previously occupied by tank type water heaters.

In accordance with another aspect of the invention, the modularized systems may include one or more tankless water heaters and a separate hot water storage tank for providing a drawdown supply of hot water as needed.

In accordance with another aspect of the invention, the modularized systems may include two tankless water heaters to provide increased hot water output and redundancy protection.

In accordance with another aspect of the invention, the water from the storage tank may be recirculated through the tankless water heater or heaters and back to the tank as needed to maintain the desired water temperature in the tank.

In accordance with another aspect of the invention, isolation valves and quick connectors may be provided for easy replacement of any failed components without having to replace the entire systems.

In accordance with another aspect of the invention, the rack includes a base for mounting of the storage tank and one or more upstanding supports adjacent an end or side of the base for mounting of the tankless water heater or heaters for ease of on site servicing and/or replacement of the individual component parts as needed.

In accordance with another aspect of the invention, the tankless water heater or heaters, storage tank and water pump used to recirculate the water between the water heater or heaters and storage tank may be preplumbed for ease of connection to a cold water supply.

In accordance with another aspect of the invention, gas lines to the tankless water heater or heaters may be preplumbed for ease of connection to a gas supply.

In accordance with another aspect of the invention, the modular systems may include an electrical box mounted on the rack for ease of plugging and unplugging of any of the systems' electrical components and connection of the systems' electrical components to an electrical power supply.

These and other advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

The present invention may be more readily understood by reference to the following drawings in which.

DETAILED DESCRIPTION

Figure 1:
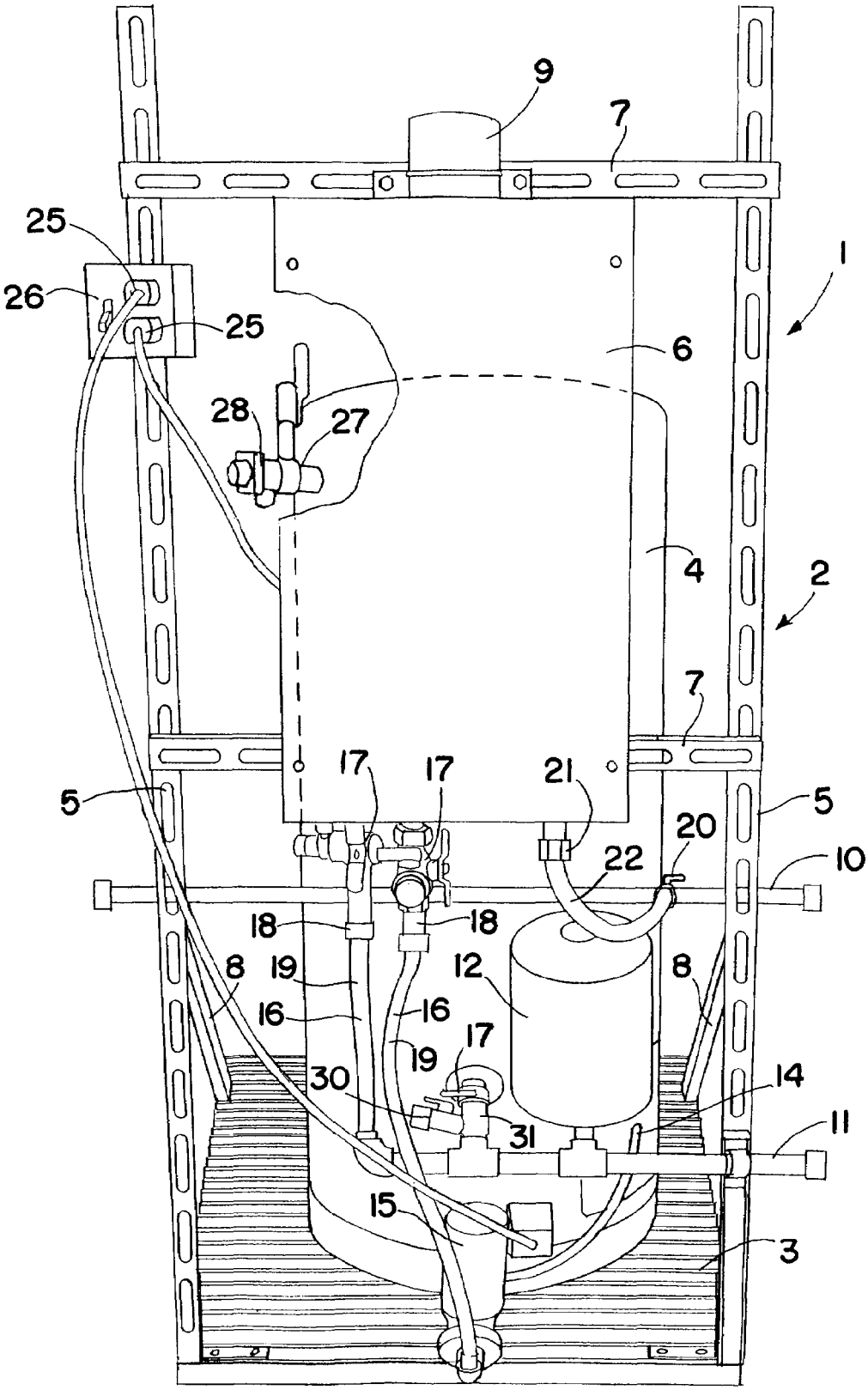
FIG. 1 is a fragmentary front perspective view of one form of modular water heating system of the present invention.
Figure 2:
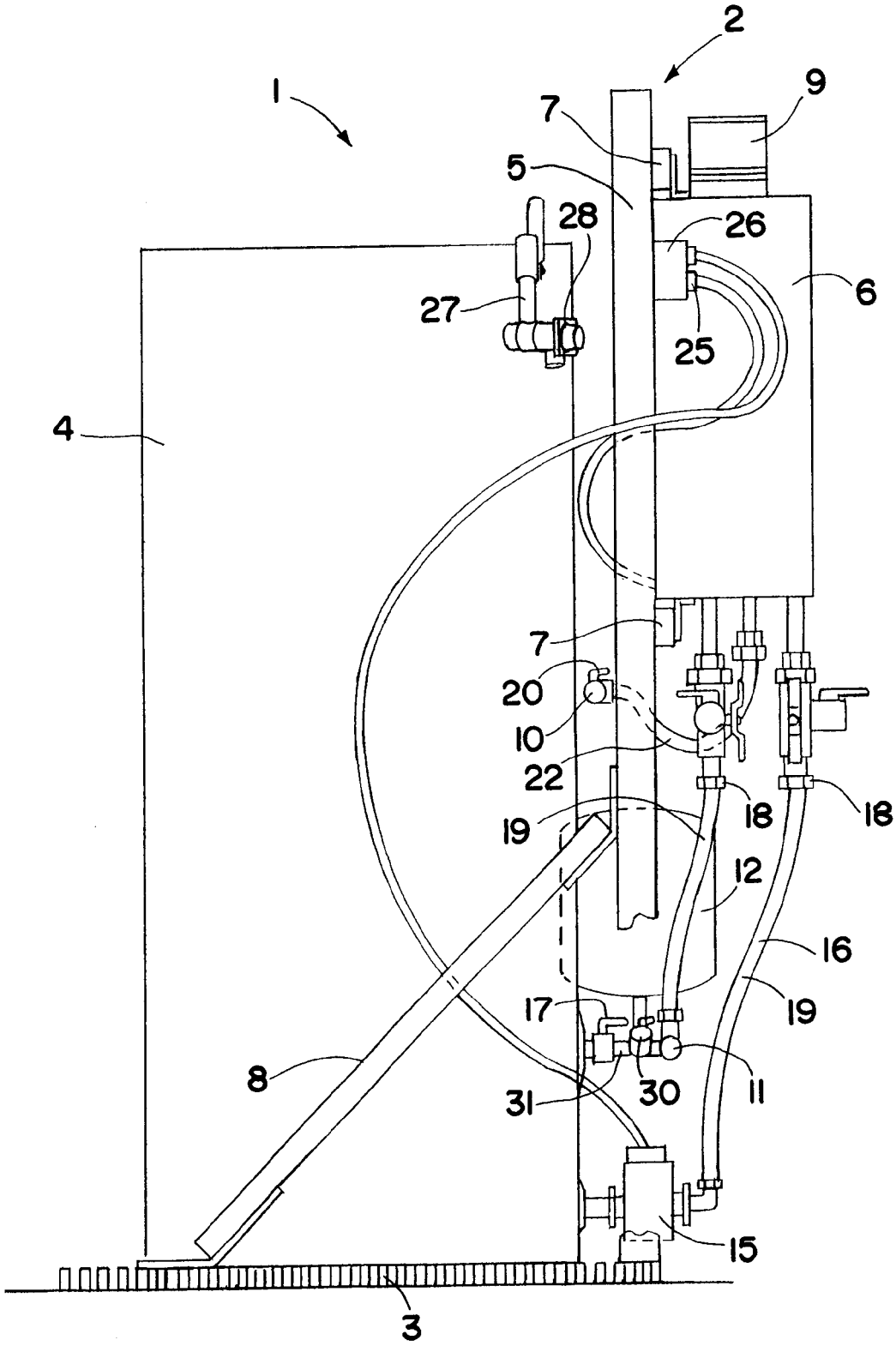
FIG. 2 is a fragmentary side elevation view of the system of FIG. 1 as seen from the left hand side thereof.
Figure 3:
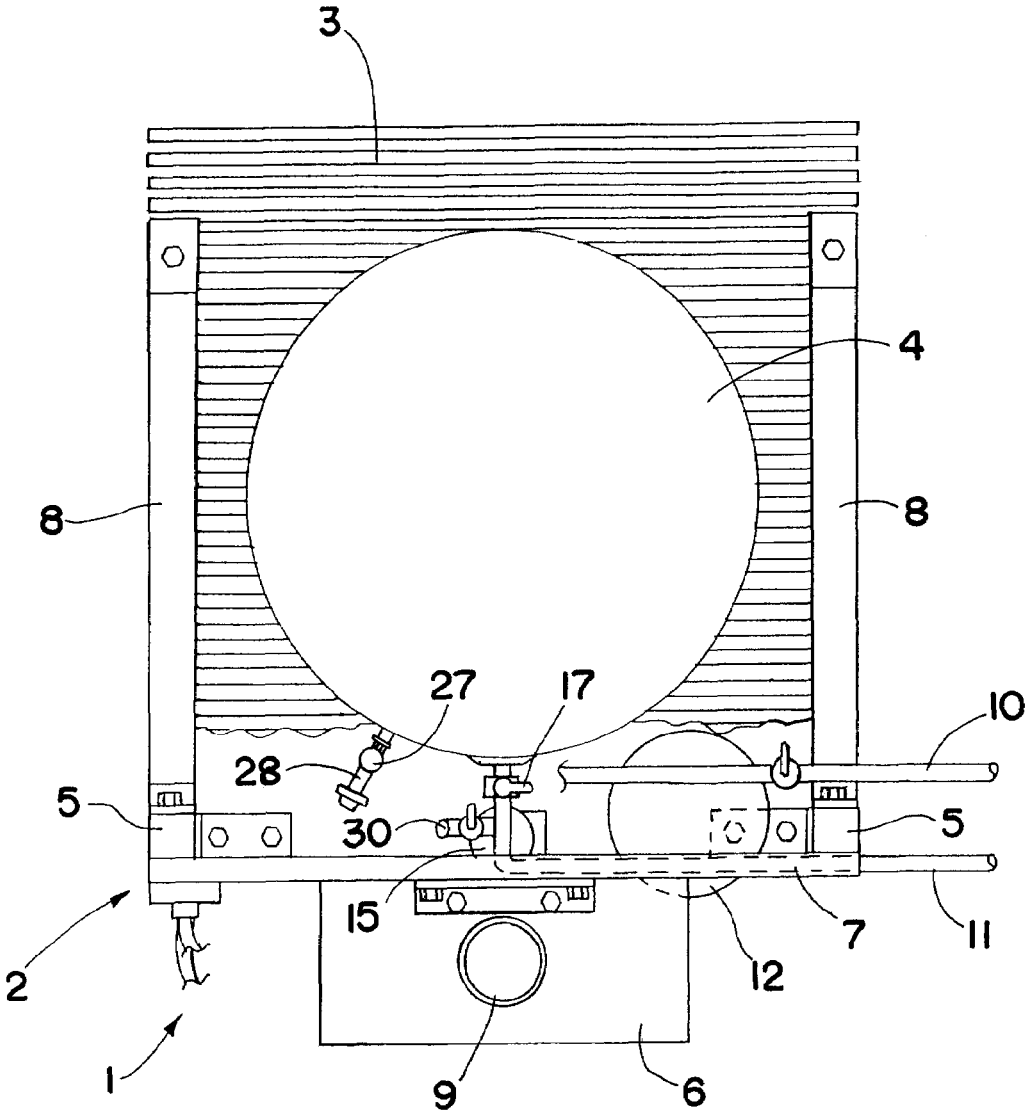
FIG. 3 is a fragmentary top plan view of the system of FIGS. 1 and 2.

Referring now in detail to the drawings, wherein the same reference numbers are used to designate like parts, and initially to FIGS. 1-3, there is shown one form of self-contained modularized water heating system 1 of the present invention including individual component parts mounted on a self-standing rack 2 for ease of installation of the entire system as a unit and replacement of individual component parts as needed without having to replace the entire system as described hereafter.

Rack 2 includes a base 3, which may be a metal grid that may be large enough to be able to removably mount any one of several different sized water storage tanks 4 thereon, for example, a 60 gallon, 80 gallon or 119 gallon storage tank. By way of example, base 3 may be approximately 30 inches wide by 36 inches deep and may have one or more upstanding rails 5 extending upwardly from one end (or side) for removably mounting one or two commercial tankless water heaters 6 thereon. These vertical members 5 may be connected together by one or more cross members 7 extending therebetween and braced by angled braces 8 extending at an angle between the vertical supports and base. Otherwise the sides, front and back of the rack are desirably substantially open for easy access to the various component parts for service and/or replacement as needed.

Figure 4:
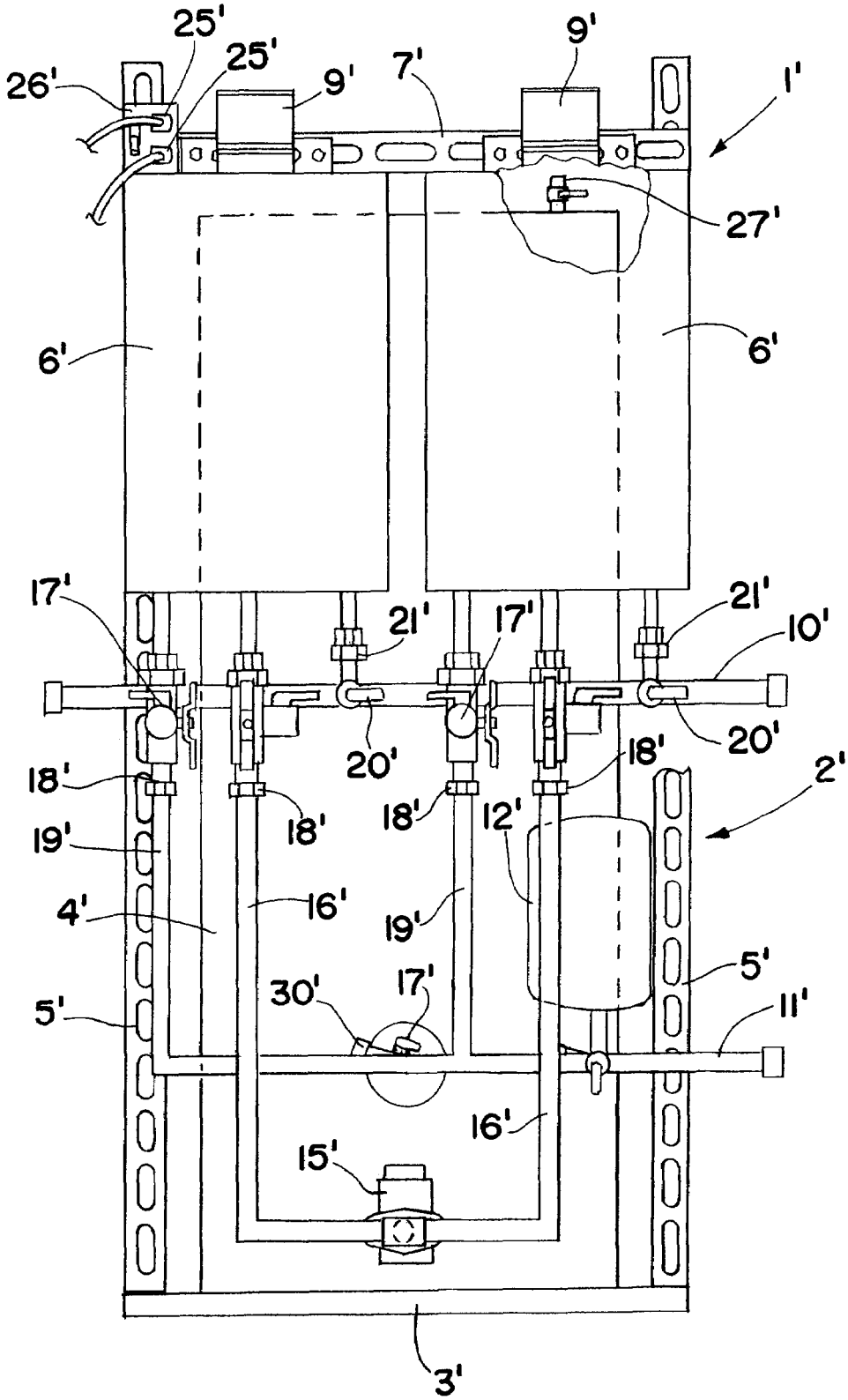
FIG. 4 is a schematic fragmentary front elevation view of another form of modular water heating system of the present invention.

FIGS. 1-3 show a system 1 having one tankless water heater 6 removably mounted on the rack 2, whereas FIG. 4 shows a system 1' having two tankless water heaters 6' removably mounted on the rack 2'. Otherwise, the system 1' shown in FIG. 4 may be substantially similar to the system 1 shown in FIGS. 1-3. Accordingly, in FIG. 4 the same reference numbers follow by a prime symbol (') are used to designate like parts.

The advantage in providing a system with two tankless water heaters instead of one is that the second heater may be used to provide increased hot water output and redundancy protection in the event one of the tankless water heaters requires service or replacement. Each tankless water heater may have a heat output, for example, in the range of 89,000 to 400,000 Btus per hour.

Both systems 1 and 1' may include substantially the same size rack and may be sized to fit within substantially the same amount of floor space typically occupied by a commercial tank type water heater, which is usually 32 to 34 inches in diameter plus the additional space needed to accommodate the plumbing lines connected thereto.

Substantially all of the system components of the present invention including particularly the water storage tank, tankless water heater or heaters, and associated plumbing and electrical are desirably preassembled on the rack for ease of transport and installation of the entire systems as a unit. Accordingly, once the rack is properly positioned in the desired location, all that has to be done to complete the installation is to connect the hot water feed, cold water supply and gas supply to the system's water and gas manifold lines, connect the electrical supply to an electrical outlet box mounted on the rack and properly vent the water heater flue or flues 9 to the outside.

For example, the tankless water heater 6 is shown in FIGS. 1-3 connected to a gas manifold line 10 and to a water manifold line 11 to which the water storage tank 4 is also connected. An expansion tank 12 is also shown connected to the water manifold line 11.

The storage tank 4 is included in the system 5 to provide a drawdown supply of hot water. The water from the storage tank is recirculated through the heater or heaters by a water pump 15 connected to the tank and to the heaters through water recirculation lines 16 and back through the water manifold line 11. Operation of the water pump 15 may be controlled by a thermostat control 14 (see FIG. 1) from the storage tank to the pump to maintain the water temperature in the storage tank at a desired level, for example, 140° F. for restaurant use.

The various water lines between the tankless water heater or heaters 6, storage tank 4 and water circulation pump 15 may include isolation valves 17, quick connectors 18 and flexible lines 19 for ease of connecting and disconnecting the various component parts in the event any of them require replacement. Likewise, isolation valves 20, quick disconnectors 21 and flexible gas lines 22 may be used to connect the tankless water heater or heaters to the gas manifold 10 for ease of replacing the heaters in the field. Regular plug type electrical connectors 25 may be provided for plugging the water pump 15 and controls for the tankless water heater or heaters 6 into an electrical outlet box 26 conveniently mounted on the rack 2 for ease of plugging and unplugging these various component parts as desired.

The hot water outlet 27 from the storage tank 4 and pressure relief valve 28 may either be on the side of the tank adjacent the top as shown in FIGS. 1-3 or on the top of the tank as shown in FIG. 4, depending on the size and style of water storage tank. Also a capped fitting 30 may be provided on the water inlet line 31 to the storage tank 4 as shown in FIGS. 1 and 4 for connection of the systems to a hot water recirculating pump line (not shown) for continuously recirculating hot water from the storage tank throughout a building so that hot water is immediately available where needed. If desired, the recirculation pump may be on a timer so that hot water is continuously circulated throughout the building only when there is a potential demand for it.

The modular water heating systems of the present invention have a number of advantages over equivalent commercial tank type water heaters. For example, the systems of the present invention may be 40 to 50% less expensive than equivalent tank type water heaters.

Further the systems of the present invention may weigh quite a bit less than an equivalent commercial hot water tank, and are relatively easy to handle, given that all of the modular components may be premounted on a rack that may be attached to a pallet for ease of transport using a hand truck or the like.

Also the normal life of the systems of the present invention is much longer than that of a standard commercial tank type water heater. Commercial hot water tanks usually have a life of three to four years whereas stainless steel tanks that are desirably used in the systems of the present invention have a life of ten years or more, and the tankless water heaters used in the systems of the present invention have a life of five to ten years. Further, because the systems of the present invention are modularized, the individual component parts can easily be replaced on site as needed rather than having to replace the entire systems at a substantially higher cost, as would be the case if a conventional tank type water heater failed.

Moreover, the systems that include two tankless water heaters provide increased hot water output and redundancy protection that is not possible with a standard commercial tank type water heater. If one of the tankless water heaters of these systems should fail, the other can still be used to provide hot water while the failed one is being replaced. If a commercial tank type water heater fails, no hot water is available until the entire water heater is replaced.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A modular water heating system comprising a portable self-standing rack that is positionable on a floor support, a water storage tank removably attached to the rack, at least one separate tankless water heater removably attached to the rack in spaced relation from the storage tank, and a pump for recirculating water between the storage tank and the water heater or water heaters, wherein the rack includes a modular platform on which the storage tank is mounted and a support extending upwardly from an end of the platform on which the water heater or water heaters are mounted.

2. The system of claim 1 further comprising a thermostat control for controlling operation of the pump to maintain a desired water temperature in the storage tank.

3. The system of claim 1 further comprising isolation valves in water lines between the storage tank and the pump and between the water heater or water heaters and the storage tank to facilitate replacement of one or more component parts of the system as needed.

4. The system of claim 3 further comprising flex lines and quick connectors in the water lines to facilitate replacement of any of the component parts as needed.

5. The system of claim 1 which includes only one tankless water heater.

6. The system of claim 1 which includes two separate tankless water heaters separately removably attached to the rack in spaced relation from each other and from the water storage tank.

7. The system of claim 6 wherein the water heaters are connected to the storage tank and the pump via water lines in parallel to provide for redundancy and increased water heating capability.

8. The system of claim 7 wherein the water lines include flex lines and quick connectors to facilitate replacement of any one of the water heaters, storage tank and pump as needed.

9. The system of claim 1 further comprising a water expansion tank in fluid communication with the storage tank.

10. The system of claim 1 further comprising a flexible gas line extending from the water heater or water heaters to facilitate connecting the water heater or water heaters to a gas supply source.

11. The system of claim 1 wherein the rack with the storage tank and the water heater or water heaters attached thereto is sized to fit within a 32 to 34 inch diameter space normally occupied by a standard commercial tank type water heater.

12. The system of claim 1 wherein the water heater or water heaters are mounted on an outwardly facing side of the support.

13. The system of claim 1 wherein opposite sides of the platform and the end opposite the support are substantially open to facilitate access and replacement of the storage tank as needed.

14. A modular water heating system comprising a portable self-standing rack that is positionable on a floor support, the rack having a base, a storage tank removably attached to the base, at least one tankless water heater removably attached to a support extending upwardly from the base in spaced relation from the storage tank, water lines running from the water heater or water heaters to the storage tank and back to the water heater or water heaters, and a pump for recirculating water through the water lines between the storage tank and the water heater or water heaters, wherein the rack includes a modular platform on which the storage tank is removably attached, and the support extends upwardly from the platform on which the water heater or water heaters are removably attached.

15. The system of claim 14 further comprising isolation valves in the water lines between the storage tank and the pump and between the water heater or heaters and the storage tank to facilitate replacement of one or more component parts of the system as needed.

16. The system of claim 15 further comprising flex lines and quick connectors in the water lines to facilitate replacement of any of the component parts as needed.

17. The system of claim 14 which includes two separate tankless water heaters that are removably attached to the support in spaced relation from each other and from the water storage tank.

18. The system of claim 17 wherein both water heaters are connected to the storage tank and to the pump via water lines in parallel to provide for redundancy and increased water heating capability.

19. The system of claim 18 wherein the water lines include flex lines and quick connectors to facilitate replacement of any of the component parts as needed.

* * * * *